US005529008A

United States Patent [19]

Craig

[11] Patent Number: 5,529,008

[45] Date of Patent: Jun. 25, 1996

[54] CATAMARAN TYPE WATERCRAFT

[76] Inventor: Robert W. Craig, 1020 Black Willow Dr., Oviedo, Fla. 32765

[21] Appl. No.: 368,541

[22] Filed: Jan. 4, 1995

[51] Int. Cl.[6] ..... B63B 1/12

[52] U.S. Cl. ..... 114/61; 114/363

[58] Field of Search ..... 114/61, 363; 248/501, 248/187; 297/440.22, 452.21, 452.25, 311, 344.1

[56] References Cited

U.S. PATENT DOCUMENTS

| | | | |
|---|---|---|---|
| 3,210,783 | 10/1965 | Petty | 114/61 |
| 4,089,291 | 5/1978 | Craig | 114/270 |
| 4,295,236 | 10/1981 | Upchurch | 114/61 |
| 4,303,033 | 12/1981 | King | 114/61 |
| 5,082,328 | 1/1992 | Garelick | 297/344.1 |
| 5,259,331 | 11/1993 | Hagan | 114/61 |

*Primary Examiner*—Sherman Basinger
*Attorney, Agent, or Firm*—William W. Haefliger

[57] ABSTRACT

A watercraft comprises two generally longitudinally and horizontally forwardly elongated floats which are laterally spaced apart, the floats having shallow draft; a horizontal platform overlying the floats and spaced thereabove, the platform removably attached to the floats, the platform also extending generally horizontally; at least one seat on the platform having an upright back facing forwardly, the platform being cut away generally forwardly of the seat to provide leg spaces through which upper portions of the floats are vertically accessible; and an upright power unit carried by the platform generally rearwardly of the seat, there being structure attached to the platform rearwardly of the seat and carrying the unit, the unit including propulsion structure located below the level of the floats and generally vertically below the level of the platform, the unit being manually manipulable to rotate the propulsion means about an upright axis.

10 Claims, 3 Drawing Sheets

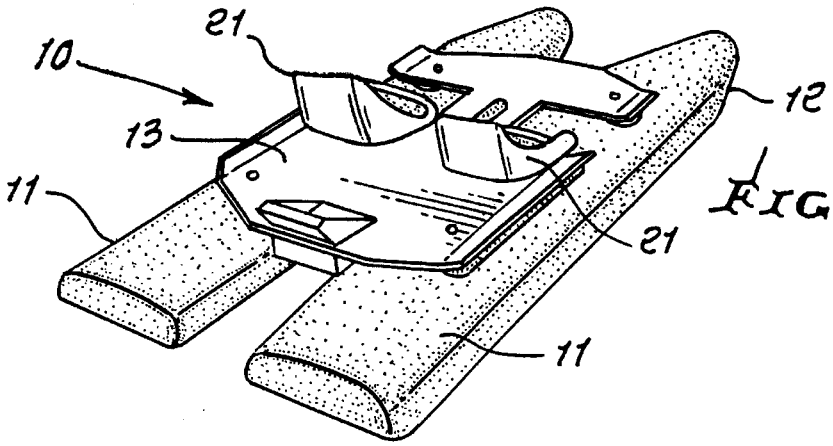
FIG. 1.
FIG. 2.
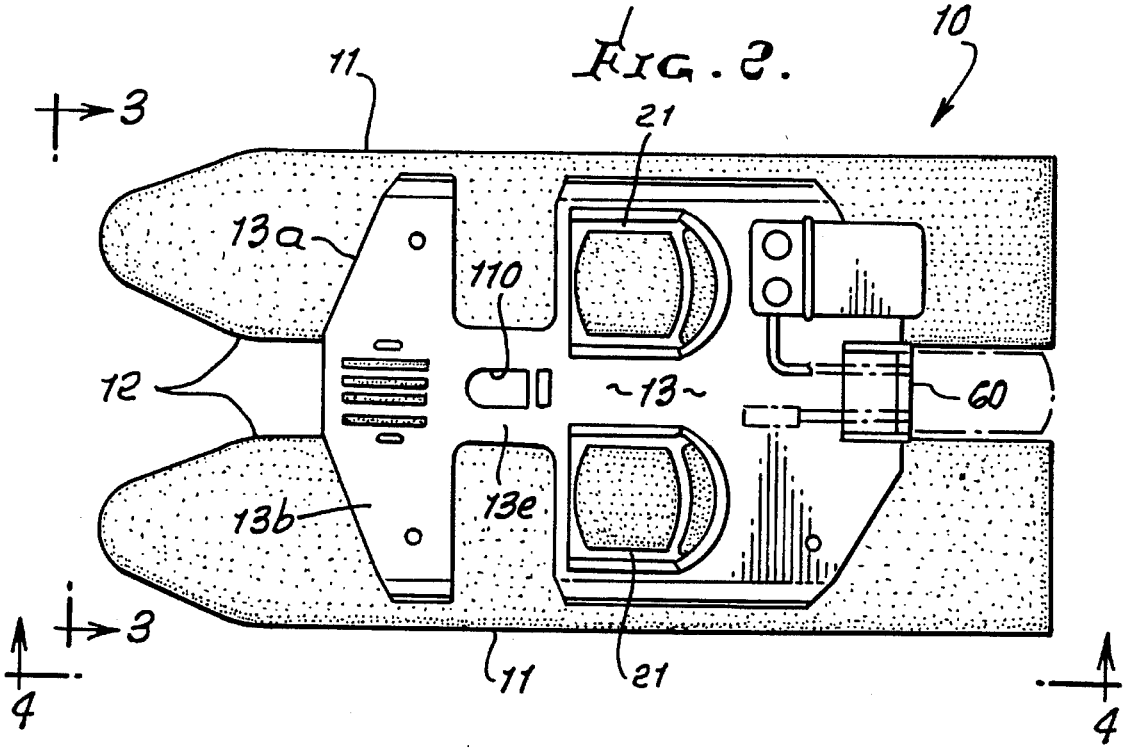
FIG. 6.
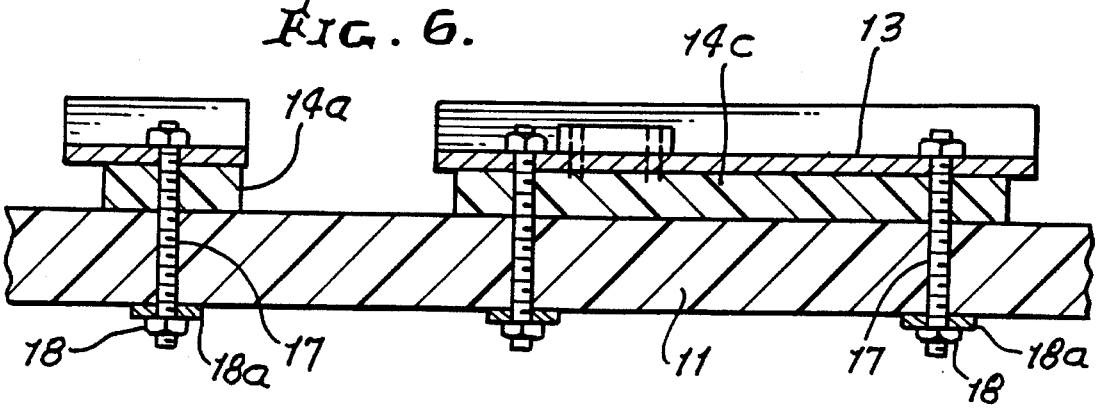

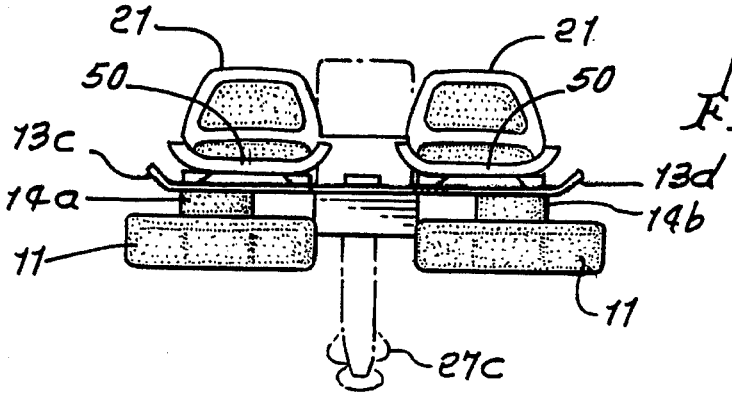
FIG. 3.
FIG. 4.
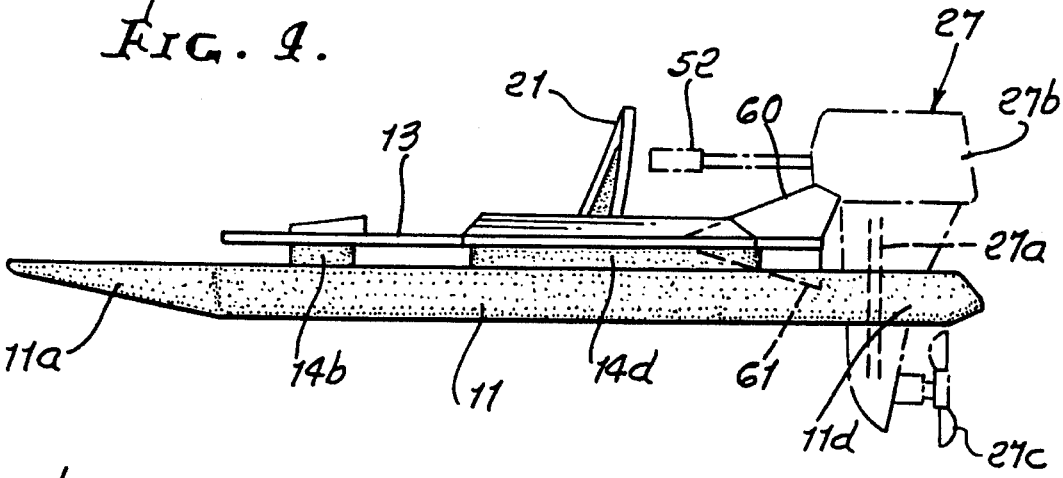
FIG. 5.
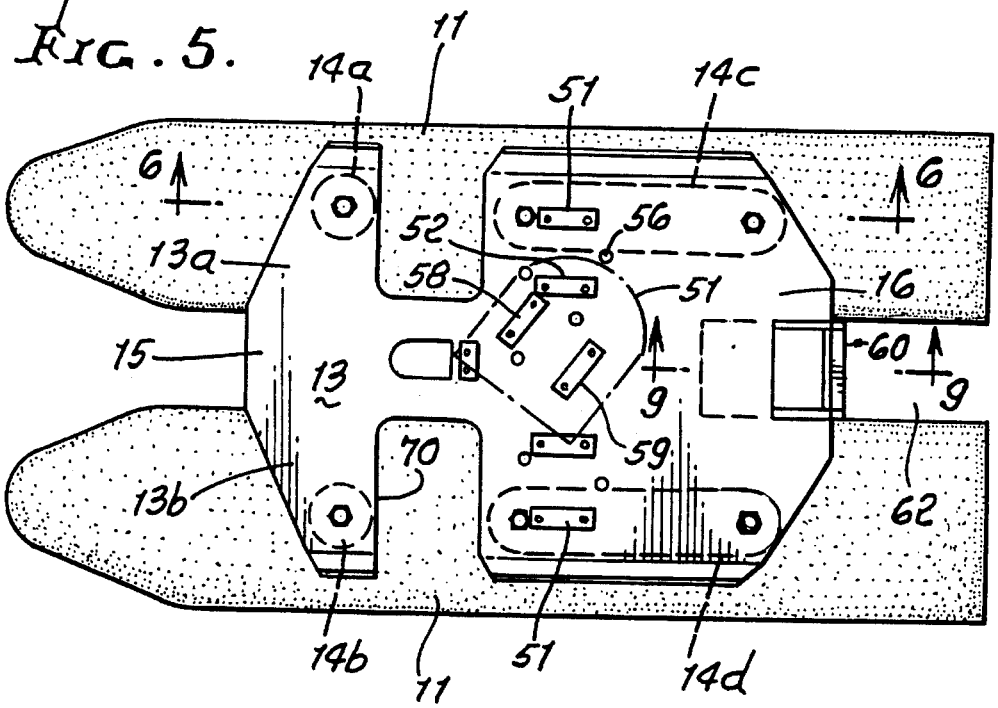

CATAMARAN TYPE WATERCRAFT

BACKGROUND OF THE INVENTION

This invention relates generally to pleasure watercraft, and more particularly concerns a small sized, powered, highly maneuverable, portable vehicle.

Related prior art craft include surfboards, floats, small catamarans and similar devices. None of these, to my knowledge, embody the unusual combinations and sub-combinations of structure, mode of operation and results as are now afforded by the present invention.

SUMMARY OF THE INVENTION

It is a major object of the invention to provide a recreational watercraft characterized by a high degree of stability and maneuverability, ease of operation, safety, and simplicity of construction facilitating disassembly and portability. Fundamentally, the craft comprises a) two generally longitudinally and horizontally forwardly elongated floats which are laterally spaced apart, the floats having shallow draft, b) a horizontal platform overlying the floats and spaced thereabove, the platform removably attached to the floats, the platform also extending generally horizontally, c) at least one seat on the platform having an upright back facing forwardly, the platform being cut away generally forwardly of the seat to provide leg spaces through which upper portions of the floats are vertically accessible, and d) an upright power unit carried by the platform generally rearwardly of the seat, there being structure attached to the platform rearwardly of the seat and carrying the unit, the unit including propulsion means located below the level of the floats and generally vertically below the level of the platform, said unit being manually manipulable to rotate the propulsion means about an upright axis.

As will appear, the platform may be removably attached to the floats, and two seats removably attached to the platform, whereby the craft may be easily disassembled and transported as by a land vehicle; the floats may comprise simple foamed plastic bodies having substantially flat bottoms; the platform may define laterally extending wings overlying the floats, forwardly of leg spaces, to provide foot rests; the platform and floats may have a very low profile, in elevation and with the seats removed to enable stacking of multiple such sub-combinations, for transport; and the power unit may include a vertical shaft projecting downwardly between the floats, there being a steering element on the upper end of the shaft and a propulsion means at the lower end of the shaft, the unit being rotatable to facilitate steering.

A further object is to provide an additional and central seat attachment to the deck located between the attachments of the two left and right seat attachments to the deck, the additional attachment angled to enable the user to more easily control a tiller for the power unit.

These and other objects and advantages of the invention, as well as the details of an illustrative embodiment, will be more fully understood from the following description and drawings, in which:

DRAWING DESCRIPTION

FIG. 1 is a perspective view of a watercraft embodying the invention;

FIG. 2 is an enlarged, to plan view of the FIG. 1 watercraft;

FIG. 3 is a front elevation taken on lines 3—3 of FIG. 2;

FIG. 4 is a side elevation taken on lines 4—4 of FIG. 2;

FIG. 5 is a top plan view showing platform construction below the seats, and also indicating spacer locations;

FIG. 6 is an enlarged vertical elevation taken on lines 6—6 of FIG. 5;

DETAILED DESCRIPTION

Figure 7:
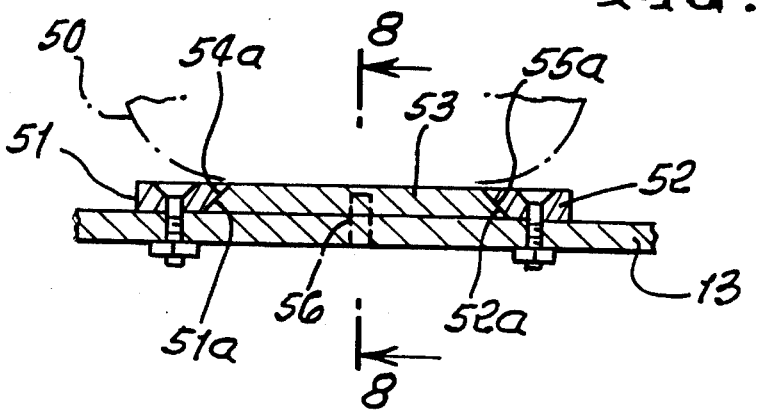
FIG. 7 is a fragmentary elevation taken in section through seat connections.
Figure 8:
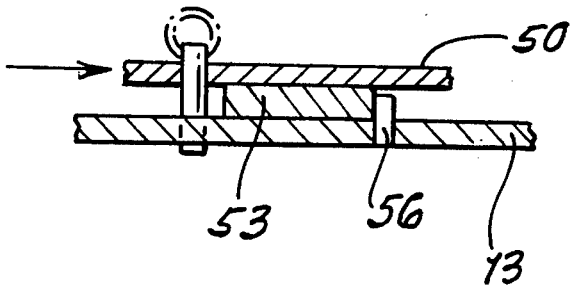
FIG. 8 is a fragmentary elevation taken in section on lines 8—8 of FIG. 7.
Figure 9:
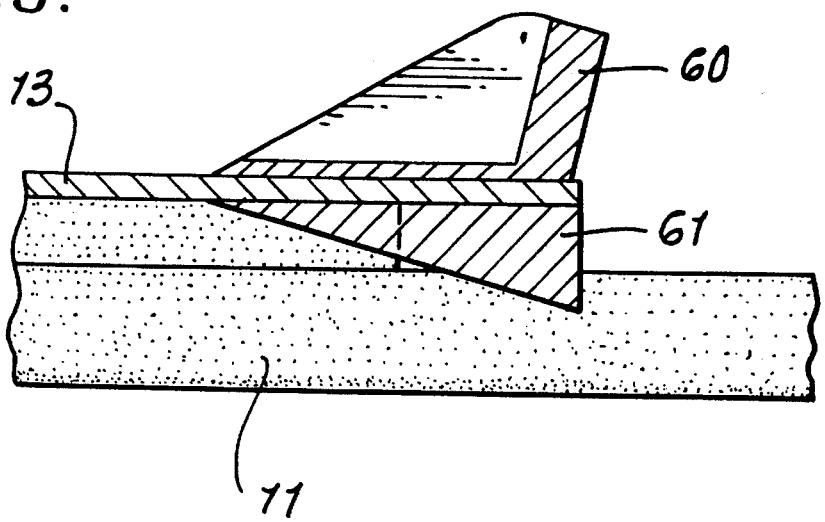
FIG. 9 is an elevation taken in section on lines 9—9 of FIG. 5.

In the drawings the watercraft 10 includes two generally longitudinally and horizontally forwardly elongated floats 11 which are laterally spaced apart. The floats have shallow draft, for quick maneuverability and may have laterally elongated, approximately rectangular cross sections in vertical lateral planes, as is clear from FIG. 3. The floats also have like outlines, in plan, each outline being generally rectangularly shaped, but tapering forwardly from loci 12 about 1/6 of the fore to aft length of each float; i.e., the laterally widest part of each float is aft from the loci 12. As a result, the floats in plan view resemble wide surfboards. The floats may consist of foamed plastic material, as for example styrofoam, or other plastic. Note also upward taper at 11*a*.

A horizontal platform 13 overlies midportions of the flat-bottomed flat topped floats and is spacers above them, as enabled by the provision of plastic spacers 14*a*–14*d* of equal height or thickness as seen in FIGS. 2 and 5. A forward platform portion includes two laterally extending wings 13*a* and 13*b* overlying forward portion 11*a* of the floats, and spaced thereabove by spacers 14*a* and 14*b*. Each float or pontoon and its spacers has inverted T-shape as is clear from FIG. 3, whereby there is abundant space 15 and 16 between the floats and between the spacers 14*a* and 14*b*, and 14*c* and 14*d*, to rearwardly pass waves, beneath the platform 13 and over the major extents of the floats, with minimum resistance. Vertical fasteners, such as NYLON bolts 17, and nuts 18, extend through the platform, spacer and floats, as shown. See also aluminum plates, 18*a*, above nuts 18, and which may be received into the undersides of the floats. The spacers may be integral with the floats. Spacers 14*a* and 14*c* are in forward longitudinal alignment, as are spacers 14*b* and 14*d*. Forward spacers 14*a* and 14*b* are circular to deflect waves, as are forward edges of elongated spacers 14*c* and 14*d*.

The ratio of the overall length L of a float to its width W is between about 4.5/1 and 6/1; and the ratio of the overall length L of the watercraft to its width C is about 2/1, whereby a high degree of craft stability and floatation, for two human passengers sitting in chairs or seats 21, is assured. The ratio of float width. W to thickness T is about 4/1.

The craft includes two seats 21, which are laterally spaced, each seat for example being of one-piece: plastic construction. Shallow U-shaped supports 50 for the seats, as seen in FIG. 3, are removably attachable to deck or platform. See two laterally spaced pairs of bars or rails 51 and 52 bolted to the platform 13 and extending longitudinally. The bars have undercut beveled inner sides 51*a* and 52*a*, to receive them between a plate 53 integral with the underside of support 50. Plate 53 has beveled outer sides. 54*a* and 55*a*, which fit adjacent bar inner sides 51*a* and 52*a*, in dove-tailed retention relation, as the plate is slidably fitted in a rearward direction between the bars. A stop pin 56 on the platform engages the plate rear edge to limit its rearward sliding. Forward sliding of the plates relative to the bars allows ready detachment of the seats from the deck or platform. Note that the large width of each float prevents such tilting of the watercraft in the event of only one passenger sitting in a chair, or seat, for example, as would prevent use of the craft. The platform is cutaway at 70 forwardly of the two seats to provide downward leg spaces, as shown.

Two additional retention bars 58 and 59 are located over and attached to a mid-portion of the deck, to enable use of a centered chair 51 angled as shown in FIG. 5. Such angle, enables the user's ready control of a tiller 52 for a power unit.

A power unit 27 such as an outboard motor 27 is carried by the platform, at its rear. See upper and lower cowlings 60 and 61 integral with the platform rearward of the seats, and above the gap 62 between the floats, to which the unit 27 may be releasably clamped. The unit 27 includes a vertical shaft 27*a*, and engine 27*b*, propeller 27*c* and a manual steering control or tiller 52. Unit 27 may be rotated about an upright axis, for steering. Propeller 27*c* is driven by the engine, via the shaft. Engine 27*b* typically is typically gasoline powered.

The platform 13 has upwardly turned lateral edges 13*a* and 13*b*, as shown, and the platform 13 interconnects the two floats. After chair or seat removal, the floats and platforms of multiple watercraft 10 may be easily stacked.

It is found that the location of the rear power unit relative to the floats, i.e. forward of their rear ends 11*d*, and between the floats, causes the craft to bank desirably, into a turn, for stability.

The present watercraft constitutes a high-performance, motorized, banking catamaran employing a gasoline powered rear-mounted outboard motor. It provides stability, easy operation, lightweight, portability and low cost. The deck or platform is configured so as not to collect water. It consists of hand layered glass fiber and resin. The pontoons consist of rigid polyethylene foam for very high strength. A canopy may be employed over the seats. A vertical opening 110 through the narrowed deck region 13*e* forward of the seats allow for downward insertion of the drive shaft of an electric powered unit, as described in U.S. Pat. No. 4,089,291. The invention is an improvement over the invention of that patent.

From the above, and as seen in the drawings, it will be seen that watercraft comprises:

a) two generally longitudinally and horizontally forwardly elongated floats which are laterally spaced apart, the floats having shallow draft, b) a horizontal platform overlying the floats and spaced thereabove, the platform removably attached to the floats, the platform also extending generally horizontally, c) at least one seat on the platform having an upright back facing forwardly, the platform being cut away generally forwardly of the seat to provide leg spaces through which upper portions of the floats are vertically accessible, and d) an upright power unit carried by the platform generally rearwardly of the seat, there being structure attached to the platform rearwardly of the seat and carrying the unit, the unit including propulsion means located below the level of the floats and generally vertically below the level of the platform, said unit being manually manipulable to rotate the propulsion means about an upright axis, e) the floats having aft ends which are squared off, laterally, the two floats proximate said aft ends having spacing therebetween which is substantially less than the width of each float proximate said aft end thereof, f) each float having upper and lower sides which extend in parallel relation, and define thickness therebetween, each float having laterally spaced opposite sides which extend longitudinally in parallel relation, the float having width between said laterally opposite sides which is several times the float thickness throughout substantially the entire float length, there being a gap between the floats and which extends forwardly from said spacing between said aft ends, said width of each float substantially exceeding the width of said gap along the gap length, said lower side of each float tapering upwardly and forwardly proximate the float forward end and between said lower and upper sides.

I claim:

1. In a watercraft, the combination comprising a) two generally longitudinally and horizontally forwardly elongated floats which are laterally spaced apart, the floats having shallow draft, b) a horizontal platform overlying the floats and spaced thereabove, the platform removably attached to the floats, the platform also extending generally horizontally, c) at least one seat on the platform having an upright back facing forwardly, the platform being cut away generally forwardly of the seat to provide leg spaces through which upper portions of the floats are vertically accessible, and d) an upright power unit carried by the platform generally rearwardly of the seat, there being structure attached to the platform rearwardly of the seat and carrying the unit, the unit including propulsion means located below the level of the floats and generally vertically below the level of the platform, said unit being manually manipulable to rotate the propulsion means about an upright axis, e) the floats having aft ends which are squared off, laterally, the two floats proximate said aft ends having spacing therebetween which is substantially less than the width of each float proximate said aft end thereof, f) each float having upper and lower sides which extend in parallel relation, and define thickness therebetween, each float having laterally spaced opposite sides which extend longitudinally in parallel relation, the float having width between said laterally opposite sides which is several times the float thickness throughout substantially the entire float length, there being a gap between the floats and which extends forwardly from said spacing between said aft ends, said width of each float substantially exceeding the width of said gap along the gap length, said lower side of each float tapering upwardly and forwardly proximate the float forward end and between said lower and upper sides.

2. The combination of claim 1 including certain fasteners removably attaching the platform to the floats.

3. The combination of claim 2 including retainer bars removably attaching the seat to the platform.

4. The combination of claim 1 wherein there are two seats on the platform and located above the two floats, respectively.

5. The combination of claim 4 wherein the floats and platform have a low profile, in elevation, the height of which profile is less than the maximum lateral width of each float, whereby multiple of said float and platform combinations may be stacked for transport after removal of the seats and said unit.

6. The combination of claim 1.wherein the platform includes laterally extending wings overlying the floats forwardly of the leg spaces, said wings providing foot rests.

7. The combination of claim 1 including spacers clamped between the floats and the platform.

8. In a watercraft, the combination comprising a) two generally longitudinally and horizontally forwardly elongated floats which are laterally spaced apart, the floats having shallow draft, b) a horizontal platform overlying the floats and spaced thereabove, the platform attached to the floats, the platform also extending generally horizontally, c) two seats on the platform, each having an upright back facing forwardly, the platform being cut away generally forwardly of the seats to provide leg spaces through which upper portions of the floats are vertically accessible, and d) a power unit carried by the platform and extending generally vertically, the unit including a manual control rearwardly of the seats and a propulsion means located below the level of the floats, said control being manually manipulable to rotate the propulsion means about an upright axis defined by the unit, e) there being spacers between the floats and platform, and upright fasteners passing through the spacers and attaching the seats to the platform, vertically, f) there being supports for the seats that have portions projecting laterally and upwardly, g) the platform having forwardly elongated edge portions that project laterally and upwardly below said seat support portions.

9. The combination of claim 8 wherein the floats have horizontally flat bottoms, and wherein:

i) the ratio of float overall length to width is between 4.5/1 and 6/1, ii) the ratio of watercraft length to width is about 2/1, iii) the ratio of float width to thickness is about 4/1.

10. In a watercraft, the combination comprising a) two generally longitudinally and horizontally forwardly elongated floats which are laterally spaced apart, the floats having shallow draft, there being a forwardly elongated gap between the floats, b) a horizontal platform overlying the floats and spaced thereabove, the platform attached to the floats, the platform also extending generally horizontally, c) two seats on the platform and having upright backs facing forwardly, the platform being cut away generally forwardly of the seats to provide leg spaces through which upper portions of the floats are vertically accessible, and d) a power unit carried by the platform and extending generally vertically, the unit including a manual control rearwardly of the seats and a propulsion means located below the level of the floats, said control being manually manipulable to rotate the propulsion means about an upright axis defined by the unit, e) said platform including laterally extending wings overlying the floats forwardly of the leg spaces, said wings providing foot rests, f) there being spacers between the wings and the floats, said wings attached to the floats via said spacers, g) and two sets of longitudinally elongated dovetail connectors slidably attaching the seats to the platform, h) there being an additional set of dovetail connectors located above said gap, said additional connectors being elongated to extend at substantial angularity relative to longitudinal.

* * * * *